US005303486A

United States Patent [19]

Dell

[11] Patent Number: 5,303,486

[45] Date of Patent: Apr. 19, 1994

[54] QUILTING HOOP

[76] Inventor: Gay D. Dell, 911 City Park Ave., Columbus, Ohio 43206

[21] Appl. No.: 877,751

[22] Filed: May 4, 1992

[51] Int. Cl.[5] ..... D05C 1/04

[52] U.S. Cl. ..... 38/102.2

[58] Field of Search ..... 38/102, 102.1, 102.2, 38/102.4, 102.91; 101/127.1; 160/369, 371, 378, 380, 395

[56] References Cited

U.S. PATENT DOCUMENTS

| | | | |
|---|---|---|---|
| 570,940 | 11/1896 | Maynard | 38/102.2 |
| 707,353 | 8/1902 | Post | 38/102.2 |
| 901,246 | 10/1908 | Lyon | 38/102.2 |
| 929,583 | 7/1909 | Gibbs | 38/102.2 |
| 1,016,463 | 2/1912 | Wilkins | 38/102.2 |
| 1,056,966 | 3/1913 | Belding | 38/102.2 |
| 1,078,809 | 11/1913 | Thomas | 38/102.2 |
| 1,242,972 | 10/1917 | Pettit | 38/102.2 |
| 1,357,737 | 11/1920 | Solani | 38/102.2 |
| 3,906,647 | 9/1975 | Bates, Jr. | 38/102.2 |

FOREIGN PATENT DOCUMENTS

| | | | |
|---|---|---|---|
| 0651306 | 2/1929 | France | 38/102.2 |

*Primary Examiner*—Clifford D. Crowder
*Assistant Examiner*—Ismael Izaguirre
*Attorney, Agent, or Firm*—Thomas S. Baker, Jr.

[57] ABSTRACT

A rigid circular quilting hoop has an inside diameter surface and an outside diameter surface. A circumferential groove is formed in the outside diameter surface. A unitary, non-metallic, stretchable fastener having two ends is received within the circumferential groove to secure a piece of quilting material stretched over the hoop. A cord lock secures the ends of the fastener after it has been stretched to maintain a desired tension on the fastener to clamp the quilting material against the hoop.

3 Claims, 1 Drawing Sheet

QUILTING HOOP

BACKGROUND OF THE INVENTION

1. Field of the Invention

This invention relates to a quilting hoop.

Quilting material ordinarily has a fabric facing layer and a batting backing layer adhesively attached to the fabric layer. In order for a person to sew or otherwise work on quilting material, the portion of the quilting material being worked on must be held in tension. One means of tensioning the working area of quilting material involves utilizing a pair of inner and outer concentric rings in which the inner diameter of the outer ring is slightly larger than the outer diameter of the inner ring. The inner ring is placed under the quilting material, the outer ring is placed above the area of the quilting material to be worked on and the rings are moved together such that the inside diameter of the outer ring overlies the outside diameter of the inner ring with the quilting material sandwiched therebetween. One example of such a device may be seen in U.S. Pat. No. 4,723,367 to Samoilov. This patent discloses an embroidery hoop in which the inner surface of the outer hoop has a groove and the outer surface of the inner hoop has a projection adapted to be received in the groove to increase the force applied to the material trapped therebetween. Samoilov attempts to solve the problem of applying sufficient bite on the fabric between the inner and outer rings to prevent the fabric from slipping between the rings during the time a person is working on it.

Of course, when concentric inner and outer rings are utilized to tension a piece of fabric, both rings must be precisely sized and the two rings only can accommodate fabric having a very narrow range of thickness. If the thickness of the fabric changes significantly, one or both of the rings must be replaced.

It has been found desirable to provide a quilting hoop which will accommodate quilting fabrics having different thicknesses. An example of a prior art device which may be utilized to accommodate fabric of different thicknesses may be seen by referring to U.S. Pat. No. 570,940 to Maynard. This patent discloses an embroidery holder having a ring with an outer groove and a wire band which may be coiled to provide a small degree of elasticity. A cord is interlaced between the coils of the spring to take up any stretch in the spring. Another device designed to accommodate fabric having different thicknesses may be seen in U.S. Pat. No. 998,657 to Thomas. Thomas discloses an embroidery hoop having a pair of concentric rings. The inner ring is rigid and the outer ring is elastic. The elastic ring has an inner wire the ends of which are connected by springs. Another device having a fixed inner ring and a resilient outer ring may be seen by referring to U.S. Pat. No. 1,221,123 to Westhaver. In Westhaver the resilient ring consists of a plurality of rubber bands having their ends joined together. Although fabric holders having one fixed ring and a fixed length resilient outer ring accommodates fabrics having a different thickness, they lack adjustment to increase or decrease the force applied to trap the fabric between the two bands.

A fabric holding device adapted to increase or decrease the tension on a fabric trapped between an inner and outer ring may be seen in U.S. Pat. No. 1,242,972 to Pettit. In Pettit a single piece of rigid wire is adapted to fit within a groove formed in a loop to trap fabric between the groove and the wire. The ends of the wire may be twisted towards each other to tighten the wire around the fixed hoop. Lastly, U.S. Pat. No. 4,422,250 to Golan discloses a fabric holder having a fixed outer ring with an inner annular groove and an inner spring ring adapted to fit within the groove. Neither Golan nor Pettit provide means for easily adjusting the tension applied to a fabric secured on a ring.

Accordingly, it is desirable to provide a device which will support quilting materials having different thicknesses and which device is capable of being easily adjusted to increase or decrease the force applied to the perimeter of the quilting material being mounted on the device.

SUMMARY OF THE INVENTION

A circular quilting hoop has an inside diameter surface and an outside diameter surface. A groove is formed in the outside diameter surface adapted to receive a unitary, long, cylindrical, non-metallic flexible resilient fastener having two ends. This fastener has an unstretched state when not in tension and a stretched state when placed in tension. The device includes a securement means for receiving and securing each end of the fastener such that the fastener is held in tension and in a stretched state when mounted in the groove.

DESCRIPTION OF THE PREFERRED EMBODIMENT

Figure 1:
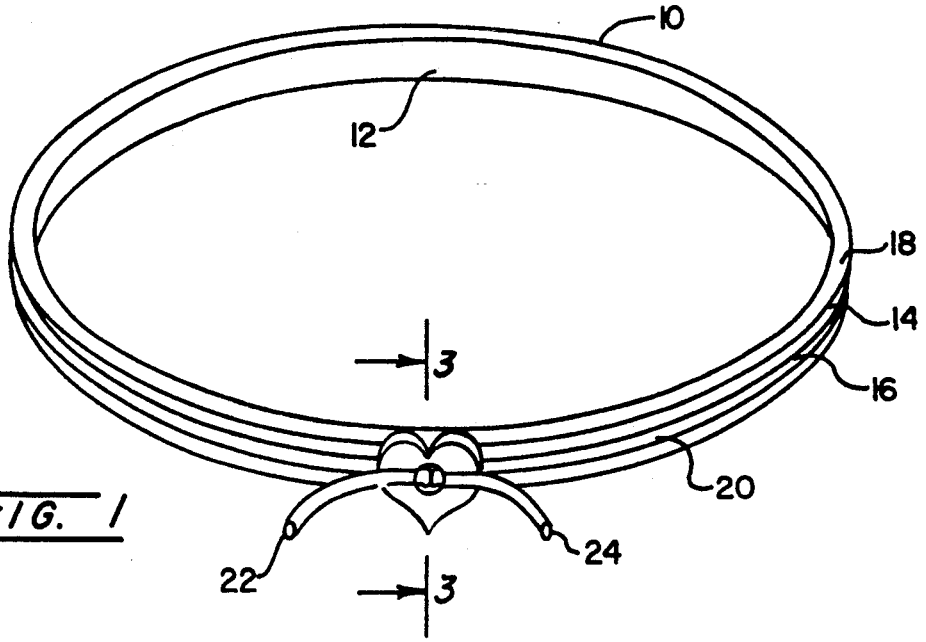
FIG. 1 is a perspective view of the quilting hoop of the present invention.

Turning to FIG. 1 of the drawings a circular, ring-shaped quilting hoop (10) which may be constructed of wood has a flat inside diameter surface (12) and an outside diameter surface (14). Outside diameter (14) contains a central circumferential concave shaped groove (16). Preferably, hoop (10) has an outside diameter of approximately 14 inches and the inside diameter and outside diameter surfaces (12 and 14) respectively are separated by a lateral wall (18) having a thickness of approximately 0.50 inches. Where hoop (10) has been constructed of wood, a plurality of laminations may be utilized in the construction. When this occurs it has been found desirable to make the depth of the groove (16) equal to approximately one-half the thickness of the lateral wall (18). Accordingly, groove (16) may have a semi-circular cross section as depicted in FIG. 3 formed from a circle having a diameter of 0.50 inches and a radius of 0.25 inches.

In use, quilting material, not shown, overlies the outer diameter surface (14) of hoop (10) and is secured by a unitary, long, slender, non-metallic, flexible, resilient, cord-like fastener (20) having a pair of ends (22 and 24). When cord ends (22 and 24) are pulled cord (20) is placed in tension and stretched and applies a lateral force tending to press quilting fabric against the surface defining groove (16). In other words, the quilting fabric becomes trapped between the surface defining groove (16) and cord fastener (20). Of course, as ends (22 and 24) are pulled tighter, the tension on cord fastener (20) increases which in turn increases the lateral force fastener (20) applies to the quilting fabric. Thus, it may be seen that by adjusting the tension applied to cord fastener (20) the force applied to the quilting fabric also is adjusted.

As mentioned previously, cord fastener (20) is formed from a non-metallic, flexible, resilient material. It has been found that a cord type material having a central elastic material with a cloth outer covering marketed under the trademark Bungie Cord makes a satisfactory cord fastener.

Figure 2:
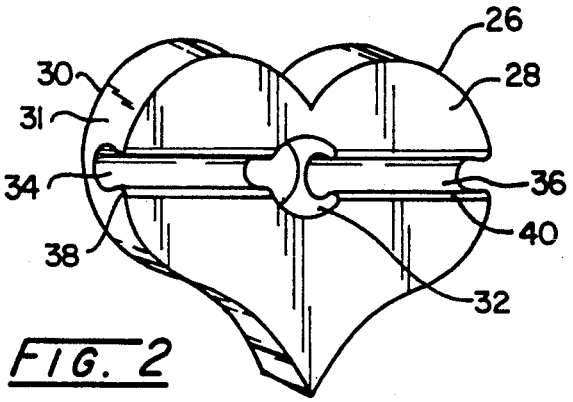
FIG. 2 is a perspective view of the preferred embodiment of the fastener lock of the present invention.
Figure 3:
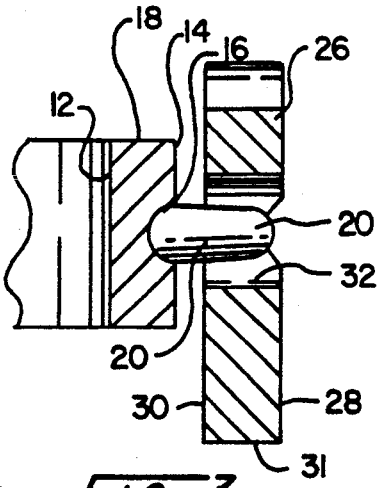
FIG. 3 is a view along line 3—3 of FIG. 1.

Turning to FIGS. 2 and 3 it may be observed that the outer ends (22 and 24) of cord fastener (20) are secured by a fastener lock (26). Although the fastener lock (26) depicted in FIGS. 1 through 3 has the shape of a heart, the exact shape of the device is unimportant and could be circular, rectangular, etc. Fastener lock (26) has a relatively flat front face (28) and a substantially parallel rear face (30) separated therefrom by a side wall (31). Fastener lock (26) also has a central, through, lateral opening (32) which extends between the front and rear faces (28 and 30) respectively. Although opening (32) has been illustrated as circular in FIGS. 1 through 3, opening (32) also could have other shapes.

Turning to FIG. 2, a pair of part-circular grooves (34 and 36) are formed in the front face (28) of fastener lock (26). One end of each of the grooves (34 and 36) intersects lateral opening (32) and the other end of the grooves (34 and 36) open into the side wall (31). Additionally, the grooves (34 and 36) are located such that their side walls open into the front face (28) of lock (26) in such a manner as to form a pair of slits (38 and 40) respectively.

As mentioned above, cord fastener (20) is flexible and resilient and stretches when placed in tension. As cord fastener (20) stretches its cross sectional area becomes smaller. Accordingly, in order for fastener lock (26) to secure the outer ends (22 and 24) of cord fastener (20), the cross sectional area of the part-circular grooves (34 and 36) must be smaller than the cross sectional area of cord fastener (20) when the cord fastener is in an unstretched state. Of course cross sectional area of the part-circular grooves (34 and 36) must be greater than or equal to the radius of fastener cord (20) when cord (20) is in tension and in its stretched state. Also, slits (38 and 40) must be able to accommodate the diameter of fastener cord (20) when it is in tension and in a stretched state.

The operation of quilting hoop (10), cord fastener (20) and fastener lock (26) may be seen by referring again to FIGS. 1 through 3. After quilting material, not shown, has been placed over quilting hoop (10), cord fastener (20) is positioned such that it overlies and traps quilting fabric within groove (16). Thereafter, the outer ends (22 and 24) of cord fastener (20) are made to pass through the central lateral opening (32) formed in fastener lock (26). Ends (22 and 24) exit in the front face (28) of fastener lock (26). Next, the ends (22 and 24) are pulled or tensioned until cord fastener (20) applies the desired lateral force on the quilting fabric within the groove (16). Thereafter, outer end (24) is pulled parallel to the longitudinal axis of part-circular groove (36) whereas outer end (22) is pulled parallel to the longitudinal axis of part-circular groove (34). This movement will cause the cord fastener ends (22 and 24) to pass through the slits (38 and 40) respectively and enter the grooves (34 and 36) respectively. After the ends (22 and 24) are positioned within the grooves (34 and 36) the ends (22 and 24) are released. When the ends are released, the cross sectional area of the cord fastener (20) will increase slightly to cause the volume of ends (22 and 24) to completely fill the grooves (34 and 36). Consequently, the frictional force between the outer surface of the cord ends (22 and 24) and the walls defining fastener lock grooves (34 and 36) respectively and the force caused by the volume of cord fastener (20) tending to expand when tension thereon has been released will secure the ends (22 and 24) within the grooves (34 and 36).

If it is desired to increase the force of cord fastener (20) acting on the quilting material within groove (16), either or both of the ends (22 and 24) of cord fastener (20) may be pulled along the longitudinal axis of the grooves (34 and 36) respectively. Cord fastener (20) may be released from tension by placing one or both of the ends (22 and 24) thereof in tension and removing them from the grooves (36 and 40) respectively.

Figure 4:
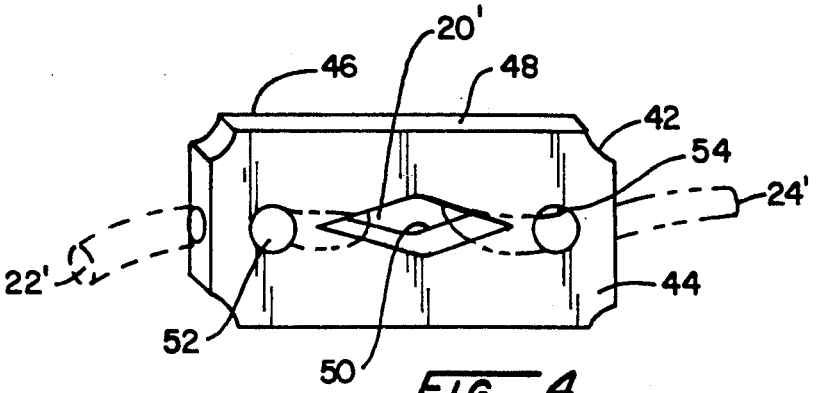
FIG. 4 is a second embodiment of a fastener lock.

FIG. 4 illustrates a fastener lock (42) which works differently than the fastener lock (26) described in conjunction with the preferred embodiment of the invention but which will satisfactorily anchor cord fastener (20) on quilting hoop (10). In the embodiment depicted in FIG. 4, fastener lock (42) is constructed from wood, has a thickness of approximately one-half inch and has a generally rectangular shape. Neither the construction material, the thickness nor the shape of the device is critical. Fastener lock (42) has a front face (44) and a rear face (46) separated by a side wall (48) and a central lateral through opening (50). Opening (50) while shown having the shape of a parallelogram also could have other shapes. Fastener lock (42) also has a pair of bores (52 and 54) which are illustrated as having one end open into the front face (44) and the other end open into the side wall (48). Alternatively, the bores (52 and 54) could be through lateral bores having one end which opens into the front face (44) and the other end which opens into the rear face (46). In any event the bores (52 and 54) have a larger diameter and or cross sectional area than that of cord fastener (20').

Fastener lock (42) secures cord fastener (20) by having the ends (22' and 24') of cord fastener (20') pass through the central lateral opening (50) and exiting from the front face (44) thereof. Thereafter, the cord ends (22' and 24') are inserted into the bores (52 and 54) respectively. The cord ends (22' and 24') enter the bores (52 and 54) respectively through the front face (44) of fastener lock (42) and exit the bores through the side wall (48). In practice, a user pulls the cord ends (22' and 24') in tension until the desired degree of force is exerted by the cord (20') on the material after the cord ends (22' and 24') have passed through the lateral opening (50) and thereafter the ends are held in tension and threaded into the bores (52 and 54). The friction between the outer surface of the cord ends (22' and 24') and the side walls of the bores (52 and 54) prevent the cord ends from pulling out of the bores.

Since certain changes may be made in the above-described system and apparatus without departing from the scope of the invention herein involved, it is intended that all matter contained in the description or shown in the accompanying drawings shall be interpreted as illustrative and not in a limiting sense.

We claim:

1. A circular quilting hoop for mounting a piece of quilting material comprising an inside diameter surface and an outside diameter surface, a groove formed in said outside diameter surface and receiving a unitary, non-metallic, stretchable fastener having two ends which overlies said quilting material received in said groove, said fastener having an unstretched state when not in tension and a stretched state when placed in tension; securement means for receiving and securing each end of said fastener such that said fastener is held in tension and in a stretched state to secure said quilting material to said hoop when said fastener is mounted in said groove;

wherein said securement means has a body with a front face and a rear face, a lateral opening formed in said body which opens into said front and rear faces which receives both ends of said fastener and a pair of bores formed in said body which open into one face adapted to receive said ends of said fastener after said ends have passed through said bore to lock said fastener ends and prevent said fastener ends from pulling back through said bore when said fastener is in said stretched state.

2. The quilting hoop of claim wherein said pair of bores have a greater diameter or cross sectional area than that of said fastener when said fastener is not in tension.

3. A rigid circular quilting hoop for mounting a piece of quilting material comprising an inside diameter surface and an outside diameter surface, a groove formed in said outside diameter surface and receiving a unitary, non-metallic, stretchable fastener having two ends which overlies said quilting material received in said groove; said fastener having an unstretched state when no in tension and a stretched state placed in tension; securement means for receiving and securing each end of said fastener such that said fastener is held in tension and in a stretched state to secure said quilting material to said hoop when said fastener is mounted in said groove;

said securement means having a body with a front face and a rear face, a lateral opening which opens into said front and rear faces formed in said body which receive both ends of said fastener and a pair of part-circular grooves formed in said front face which receive said ends of said fastener when said fastener is in said stretch state; wherein each of said grooves opens into said lateral opening: wherein said fastener has a smaller radius when in the stretched state than when in the unstretched state and wherein each of said grooves has a radium smaller than the radius of said fastener when said fastener is in said unstretched state and greater than or equal to the radius of said fastener when said fastener is in tension and in said stretched state.

* * * * *